US005189738A

United States Patent [19]

Mitchell

[11] Patent Number: 5,189,738

[45] Date of Patent: Mar. 2, 1993

[54] GARMENT SHOULDER PAD WITH POCKET

[76] Inventor: Jenna Mitchell, 719 Sunset Ave., Venice, Calif. 90291

[21] Appl. No.: 740,804

[22] Filed: Aug. 6, 1991

[51] Int. Cl.[5] ..... A41D 27/26

[52] U.S. Cl. ..... 2/268; 2/247

[58] Field of Search ..... 2/22, 23, 24, 267, 268, 2/247, 248, 249, 250

[56] References Cited

U.S. PATENT DOCUMENTS

| | | | |
|---|---|---|---|
| 1,112,254 | 9/1914 | Bloch | 2/268 |
| 2,405,030 | 7/1946 | Glickman | 2/268 |
| 2,415,698 | 2/1947 | Kreisberg | 2/268 |
| 2,420,583 | 5/1947 | Breslow et al. | 2/268 |
| 2,422,834 | 6/1947 | Kleinman | 2/268 |
| 2,423,498 | 7/1947 | Hull | 2/268 |
| 2,441,910 | 5/1948 | Serbin | 2/268 |
| 2,501,640 | 3/1950 | Woodward | 2/268 |
| 2,507,543 | 5/1950 | Prager | 2/268 |
| 2,543,513 | 12/1950 | Gerry | 2/268 |
| 2,671,223 | 3/1954 | Axsom | 2/268 |
| 3,168,746 | 2/1965 | Smith | 2/24 |
| 4,625,340 | 12/1986 | Hernandez | 2/247 |
| 4,831,666 | 5/1989 | Denman | 2/24 X |
| 4,945,576 | 8/1990 | Melton | 2/268 |

FOREIGN PATENT DOCUMENTS

| | | | |
|---|---|---|---|
| 2206154 | 12/1988 | United Kingdom | 2/268 |

OTHER PUBLICATIONS

Walter Drake ® Summer 1989 Catalog; pp. 16, 80.
Miles Kimball Catalog; pp. 117, 124.

*Primary Examiner*—Andrew M. Falik
*Assistant Examiner*—Jeanette E. Chapman
*Attorney, Agent, or Firm*—Lyon & Lyon

[57] ABSTRACT

A shoulder pad for use with a garment including a pad having a top fabric layer and a bottom fabric layer, the shoulder pad including an enclosed internal compartment into which articles may be placed and concealed. The shoulder pad preferably includes a closeable opening for providing access into the enclosed internal compartment and also preferably includes a means for detachably attaching the shoulder pad to the garment shoulder.

13 Claims, 1 Drawing Sheet

GARMENT SHOULDER PAD WITH POCKET

BACKGROUND OF THE INVENTION

There are many methods and devices for a person to carry objects. Clothing is provided with compartments (i.e. pockets) or some sort of satchel or purse may be hung over the shoulder or around the neck. There also exist several designs for concealing a particular compartment to be worn on the person. One example is a money belt in which a compartment is concealed within the belt worn about the waist. Another example is a money pouch which is typically hung around the neck and concealed about the chest area. One other such device is the carrier pocket device disclosed in U.S. Pat. No. 4,625,340 which is comprised of a textile sleeve worn around the calf, the sleeve having an open top pocket formed between the sleeve and an overlying rectangular textile sheet secured around its edges. The pocket opening is secured by a hook and loop attachment combination.

Depending upon the type of clothing being worn, pockets, pouches, or some type of concealed compartment may not be practical or desireable. A woman's wardrobe in particular is often not conducive to being equipped with pockets or other carrying pouches either from a convenience or fashion point of view. Yet, it is often desireable for a woman to be able to carry certain essential items, such as a driver's license, credit card or cash, either separate from a purse or without a purse altogether, whether for reasons of fashion or safety.

SUMMARY OF THE INVENTION

It is an object of the present invention to provide a concealed compartment which may be conveniently and fashionably combined with a garment such as a dress, jacket, shirt, sweater or the like.

The present invention is directed to a unique shoulder pad for use with a garment including a pad having a top fabric layer and a bottom fabric layer, the shoulder pad including an enclosed internal compartment or pocket into which articles may be placed and concealed. The shoulder pad includes a closeable opening for providing access into the enclosed internal compartment and preferably includes a means for detachably attaching the shoulder pad to the garment shoulder.

DETAILED DESCRIPTION OF THE PREFERRED EMBODIMENTS

The preferred embodiment of the present invention will now be described with respect to the drawings.

Figure 1:
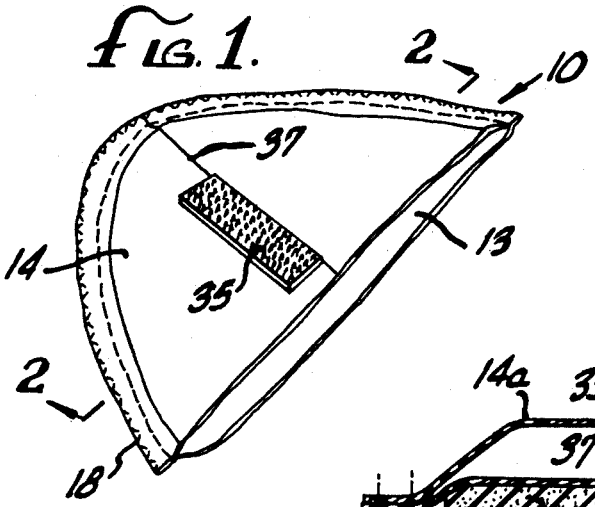
FIG. 1 is a perspective view of a shoulder pad according to the present invention with an opening along a top surface thereof.
Figure 2:
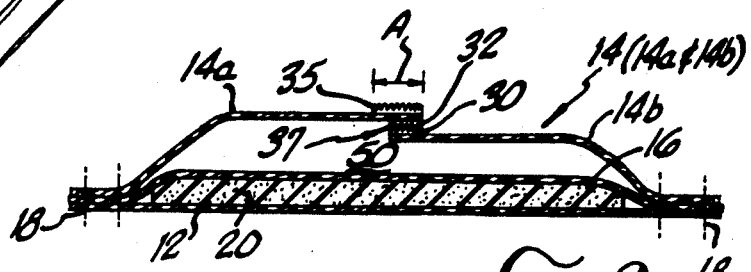
FIG. 2 is a cross-sectional view of FIG. 1 taken along the line 2—2.

FIGS. 1 and 2 illustrate a shoulder pad 10 of a generally triangular or semi-circular shape. The pad 10 is generally formed from three layers, namely a top fabric layer 14, a bottom fabric layer 12 and a center foam layer 20. A compartment 50 is formed between the top layer 14 and the foam layer 20. Actual construction of the pad 10 can be accomplished in many ways (for example the internal compartment 50 may be located beneath the foam layer 20) but the preferred construction is illustrated in FIGS. 1 and 2. The shoulder pad 10 is made by (1) folding over the generally circular or square sheet of fabric about a fold 13 which becomes a straight side edge 13 of the pad 10 and (2) securing the layers 12 and 14 together by stitching 18 or the like around the rounded leg portions. A top fabric layer 14 is formed from a first portion 14*a* and a second portion 14*b* such that there is an overlap A. The overlap A forms an opening 37 to the internal compartment 50. Articles may be then slipped into place through the overlap portion A and into the compartment 50 within the pad 10. Optionally a separate center fabric piece 16 may be placed between the padding portion 20 and the top fabric layer 14 to secure and protect the padding 20. The compartment 50 is the cavity formed between the center fabric piece 16 and the top fabric layer 14. The padding 20 may be secured or adhered to the center fabric piece 16 and/or the bottom fabric layer 12 by a suitable means (such as by stitching or fabric adhesive) or may just be assembled in a secure, tightly fitting fashion. Where the padding portion 20 is not secured or adhered but merely assembled in a secure fashion, and the center fabric piece 16 is omitted, the compartment 50 may not only be the cavity above the padding portion 20, but the compartment may be located below the padding portion 20 and may be accessed merely by moving the padding portion aside and slipping the article through the opening 37 and then beneath the padding portion 20 and then returning the padding portion 20 to its original position.

By way of example, the padding 20 preferably comprises a single piece of foam padding material which provides a desired overall structure for the pad for retaining the desired physical shape while also being soft and flexible. Alternately, where the fabric layers 12 and 16 enclose the padding 20, the material may be comprised of, for example, a fiberfill stuffing material instead of the one-piece foam pad.

The opening 37 may include closure means. One such closure means is illustrated in FIG. 2 as a hook and loop combination such as that sold under the mark VELCRO. For example, a piece of upwardly facing hook material 30 may be secured to the top surface of the lower top portion piece 14*b* and the mating piece of downwardly facing loop material 32 may be attached to the underside of the top fabric layer 14*a*. The locations of the hook material 30 and loop material 32 may be interchanged.

Another option is to include a means for detachably attaching the pad 10 in place by positioning a piece of for example an upwardly facing loop material 35 on a top surface of the top fabric layer 14 and then positioning a corresponding piece of hook material at a suitable position in the garment to achieve the desired position for the pad 10.

If provided with sufficient overlap A, the pad 10 may require no separate closure means at the opening 37. Alternatively, suitable closure means may be substituted for the preferred hook and loop combination 30, 32 such as snaps, buttons, zipper or other devices but preferably will have a smooth outer surface so as not to disturb the external contour of the garment.

Figure 3:
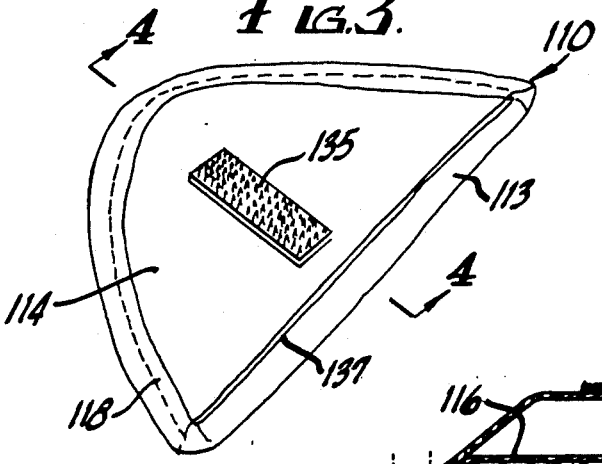
FIG. 3 is a perspective view of an alternate shoulder pad design of the present invention.
Figure 4:
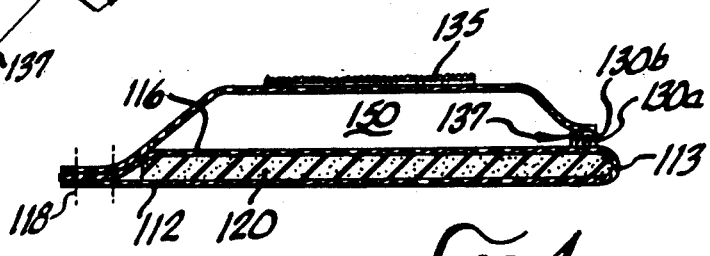
FIG. 4 is a cross-sectional view of FIG. 3 taken along the line 4—4.

FIGS. 3 and 4 illustrate an alternate pad 110 which has its compartment opening 137 along the straight side seam 113. The pad 110 is also of a generally semi-circular or triangular shape. The bottom portion with the padding 120 is preferable formed by folding over a generally circular or square piece of fabric to position a fabric piece 116 on top of the padding 120 and a fabric piece 112 below it. A top fabric layer 114 is placed above the layer 116 and the outer edges of the pad 110 are then secured together such as by stitching 118 thereby forming an internal compartment 150 between the top layer 114 and the padding 120.

Preferably a closure means is provided at the opening 137 as shown in FIG. 4, such as a suitable hook and loop combination, for example, a piece of upwardly facing hook material portion 130*a* placed along the top surface of the fabric portion 116 and a corresponding downwardly facing loop material portion 130*b* attached to the bottom surface of the top fabric layer 114 along its edge. The hook and loop portions 130*a* and 130*b* may be attached to the respective fabric layers by adhesives, stitching or other suitable means.

A means for detachably attaching the pad 110 in place to the garment shoulder, illustrated as a hook portion 135 secured to the top surface of the top fabric layer 114, may be provided in a similar fashion as described for the previous embodiment.

Figure 5:
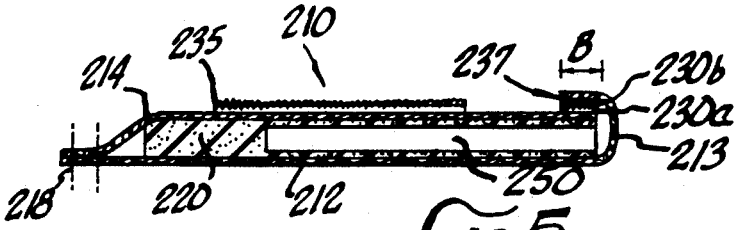
FIG. 5 is a cross-sectional view of an alternative shoulder pad design in which the compartment is housed within the internal padding.

FIG. 5 illustrates a cross sectional view of yet another embodiment of a shoulder pad 210 in which the padding material 220 is selected such that it may accommodate a compartment 250 therein. The padding material though soft would preferably have sufficient stiffness to retain its shape and also resists deterioration from wear during use. The padding 220 is placed between a top fabric layer 214 and a bottom layer 212. The top fabric layer 214 and the bottom fabric layer 212 are attached to each other around the outer circumference by suitable attachment means such as stitching 218. The bottom fabric layer 212 extends upward and wraps around to a position above the top fabric layer 214 thereby forming a side edge portion 213. As it wraps around into position above the top fabric layer 214, the upper end of bottom fabric layer 212 establishes an overlap B at the opening 237 into the compartment 250. A suitable means for closing the opening 237 is provided such as a hook and loop material combination, one being upwardly facing hook or loop material 230*a* secured to a top surface of the top fabric layer 241 which mates to a corresponding piece of hook or loop material 230*b* secured to the inner surface of the bottom fabric layer 212 which wraps around the side edge portion 213.

A suitable means for detachably attaching the pad in place on a garment shoulder may be applied to the top surface of the top fabric layer 214 which is illustrated in FIG. 5 as a piece of upwardly facing hook material 235 of similar construction to that describe in the previous embodiments.

As previously described, the described shoulder pad is readily incorporated into a garment such as a dress, jacket, shirt, sweater having a shoulder region, the pad having a first layer of material and a second layer of material, the first and second layers being attached to one another along respective outer edges so as to form an enclosed internal compartment into which articles may be placed and concealed, the pad including a closeable opening for providing access into the enclosed internal compartment and means for attaching, either permanently or detachably, the shoulder pad to the garment shoulder region at a desired location.

Though specific embodiments of a garment shoulder pad having a compartment have been shown and described, many modifications may become apparent to one skilled in the art from the disclosures herein. For example, the preferred material of construction of the layers is a soft fabric material such as cotton or polyester or some other natural or man-made fiber material. Other materials such as plastic or cellulosic material would also be suitable provided they are sufficiently soft and flexible and preferably quiet when flexed. Specific orientations for hook and loop material have been disclosed but the relative positions of the materials may be reversed as the attachment function is effective as long as the mating combination is maintained. Therefore the scope of the invention is not to be limited except in the spirit of the claims that follow.

I claim:

1. A shoulder pad for use with a garment, comprising a pad of generally triangular or semi-circular shape having a top fabric layer an intermediate fabric layer a bottom fabric layer and a layer of padding between said bottom and intermediate fabric layers which are attached along of their respective outer edges so as to enclose the layer of padding;, the top and bottom fabric layers being attached to one another along respective outer edges so as to form an enclosed internal compartment into which the articles may be placed and concealed, the pad including a closeable opening for providing access into the enclosed internal compartment and for providing for entry and removal removal of the articles therefrom.

2. A shoulder pad according to claim 1 further comprising means for detachably attaching the pad in place to a garment shoulder region.

3. A shoulder pad according to claim 2 wherein the means for detachably attaching comprises a hook and loop attachment combination with one of the hook and loop elements secured to the top of the pad and the corresponding hook and loop element attached at an appropriate location of the garment.

4. A shoulder pad according to claim 1 wherein the bottom fabric layer is constructed and arranged to enclose the layer of padding.

5. A shoulder pad according to claim 1 wherein the opening is positioned along a side edge of the pad.

6. A shoulder pad according to claim 1 wherein the opening is positioned along the center of one of the fabric layers of the pad.

7. A shoulder pad according to claim 1 further comprising a closure means for closing off the closeable opening.

8. A shoulder pad according to claim 6 further comprising a closure means for closing off the closeable opening.

9. A shoulder pad according to claim 7 wherein the closure means comprises a hook and loop combination attached to opposing overlapping surfaces of the opening.

10. A shoulder pad for use with a garment, comprising a pad of generally triangular or semi-circular shape having a top fabric layer and a bottom fabric layer, the top and bottom fabric layers being attached to one another along respective outer edges so as to form a first enclosed internal compartment into which a layer of padding is placed, the pad including a closeable opening for providing access into the enclosed internal compartment;

a layer of padding positioned between the top fabric layer the bottom fabric layer, a second internal compartment housed within the layer of padding into which articles are placed and concealed.

11. A shoulder pad according to claim 10 wherein the opening is positioned along a side edge of the pad.

12. A shoulder pad according to claim 10 further comprising a closure means for closing off the closeable opening.

13. A shoulder pad for use with a garment, comprising a pad of a generally triangular or semi-circular shape having a first layer of material, an intermediate fabric layer, a second layer of material and a layer of padding between said second and intermediate fabric layers which are attached along of their respective outer edges so as to enclose the layer of padding, the first and second layer being attached to one another along respective outer edges so as to form an enclosed internal compartment into which articles may be placed and concealed, the pad including a closeable opening for providing access into the enclosed internal compartment and for providing for convenient removal of the articles therefrom.

* * * * *